US005458266A

United States Patent [19]

Pichot

[11] Patent Number: 5,458,266

[45] Date of Patent: Oct. 17, 1995

[54] PORTABLE WEAPON CARRYING SYSTEM

[75] Inventor: Patrice Pichot, Bourges, France

[73] Assignee: Giat Industries, Versailles Cedex, France

[21] Appl. No.: 279,863

[22] Filed: Jul. 26, 1994

[30] Foreign Application Priority Data

Jul. 29, 1993 [FR] France ..... 93 09325

[51] Int. Cl.[6] ..... A45F 3/00

[52] U.S. Cl. ..... 224/244; 224/242; 224/907; 224/912; 206/317

[58] Field of Search ..... 206/317, 38; 224/232, 224/242, 912, 911, 907, 913, 244, 243, 245, 230, 234, 42.46, 225, 226; 211/64; 42/70.11

[56] References Cited

U.S. PATENT DOCUMENTS

| | | | |
|---|---|---|---|
| 653,779 | 7/1900 | Phillips | 224/230 |
| 1,951,865 | 3/1934 | Franz . | |
| 2,349,376 | 5/1944 | Ray . | |
| 2,551,913 | 5/1951 | Toby . | |
| 3,669,325 | 6/1972 | Furman | 224/243 |
| 4,925,075 | 5/1990 | Rogers | 224/244 |
| 5,255,436 | 10/1993 | Yoshida | 30/151 |

FOREIGN PATENT DOCUMENTS

| | | |
|---|---|---|
| 388448 | 6/1989 | Australia . |
| 0174908 | 3/1986 | European Pat. Off. . |

*Primary Examiner*—Robert M. Fetsuga
*Assistant Examiner*—Peter S. Hrycko
*Attorney, Agent, or Firm*—Oliff & Berridge

[57] ABSTRACT

The invention relates to a carrying system for a portable weapon having a rigid support plate, a locking device to secure the weapon on the support plate, and at least one retaining strap. The locking device has a manually controlled movable finger and an elastic element for returning the finger to a locking position where it engages a groove in the weapon to lock the weapon against the support plate. The movable finger is automatically manipulated by the thumb of the shooter's hand, when the shooter grasps the weapon, to release the locking finger from the groove.

7 Claims, 3 Drawing Sheets

PORTABLE WEAPON CARRYING SYSTEM

BACKGROUND

The invention relates to a carrying system for a portable weapon of the type having a support, a locking device to secure the weapon on the support, and at least one retaining strap.

The simplest carrying systems for a portable weapon are composed of a strap permanently attached to the weapon. Such systems have the following disadvantages in particular:

- they are unable to prevent the weapon from bouncing against the shooter's body,
- they limit the weapon support position on the shoulder or around the neck of the shooter, and
- they limit the aiming movements of the weapon when the shooter wishes to fire rapidly.

Other systems always include the use of a strap, but this is attached to the weapon at two different points for example. With these systems, the shooter must use both hands to access his weapon, one hand to hold the strap and the other hand to release the weapon. While releasing the weapon remains a simple, quick operation, the risk of untimely or inadvertent release is increased. Moreover, these systems do not prevent the weapon from bouncing against the shooter's body.

According to still other systems, a support is provided such as a pouch surrounding the barrel, part of the slide and the trigger guard of the weapon, and a flap clampable to the pouch which holds and protects the weapon. In these systems, drawing the weapon consists of three steps: unclamping the flap, extracting the weapon from the pouch, and aiming the weapon in some direction. The ease and rapidity of this sequence depends on the attaching method used to secure the flap to the pouch.

Finally, according to still other systems, a spring clip is provided which closes on the slide of the weapon. These systems require only one movement which differs little from that of aiming the weapon, but they require additional effort to release the weapon from the spring clip. The movement associated with this effort is made more difficult by the fact that it must be executed with one finger on the trigger guard or trigger of the weapon. Moreover, this effort prevents the start of the weapon aiming movement from being controlled.

SUMMARY OF THE INVENTION

A goal of the invention is to alleviate the drawbacks of the previous systems discussed above, while providing other advantages.

For this purpose, the invention proposes a carrying system for a portable weapon of the aforesaid type characterized by the support being composed of a rigid plate, a locking device supported by said plate and comprising a manually controlled movable finger that can assume two positions, and an elastic element returning the finger to one of the two positions or the locking position where it engages a groove of the weapon to lock the weapon against the plate.

According to one embodiment, the locking finger is of the pivoting type and the elastic element returning the finger into its locking position is comprised of a flat spring.

In general, the position of the groove which the finger of the locking device engages may vary from one weapon to another.

In the case of an automatic pistol with both a front and a rear grip associated respectively with a front and a rear trigger guard, the groove can advantageously be located at the rear trigger guard of the weapon, the locking device being mounted on the support plate so that it is positioned between the rear trigger guard and the front grip of the weapon.

When the weapon is drawn, it is grasped with one hand by the front grip, and the thumb of the grasping hand quite naturally contacts the locking finger causing it to pivot and be released from the groove of the rear trigger guard. The weapon is released in a direction perpendicular to the support plate and the weapon is aimed by continuing the movement started to release the weapon.

In the case of a weapon, such as an automatic pistol, the groove in which the locking finger engages can advantageously be located to the rear of the trigger guard, with the locking device being mounted on the support plate so that it is positioned to the rear of the grip.

In this case, the weapon is drawn by grasping it by its grip with one hand, whereupon the thumb of the grasping hand comes quite naturally in contact with the locking finger, causing it to pivot and be released from the groove of the grip. As before, the weapon is released in a direction perpendicular to the support plate and the weapon is aimed by continuing the movement started to release the weapon.

According to yet another characteristic of the invention, the system is supplemented by means for positioning and centering the weapon relative to the support plate, these means being comprised of pins projecting from the support plate and designed to cooperate with the weapon to position it and center it correctly against the support and allow the locking finger to engage automatically in its associated groove, when the shooter releases the weapon once it is pressed against the support, the effect of which is to bring the locking finger into its locking position under the action of the return spring.

In general, some of the pins that position and center the weapon against the support plate become positioned in the inner space delimited by the trigger guard or guards of the weapon so that they can also immobilize the associated trigger or triggers to prevent them from being accidentally actuated.

Such a system has a number of advantages, among which one may cite in particular:

- integration of the weapon and its support, which prevents the weapon from bouncing against the shooter's body,
- the ability to release the weapon and aim it in any direction in one continuous movement, and
- locking the trigger of the weapon, preventing accidental firing as long as the weapon is pressed against its support.

BRIEF DESCRIPTION OF THE DRAWINGS

Other advantages, characteristics, and details of the invention will emerge from the description hereinbelow with reference to the attached drawings provided only as an example and wherein.

DESCRIPTION OF PREFERRED EMBODIMENTS

Figure 1:
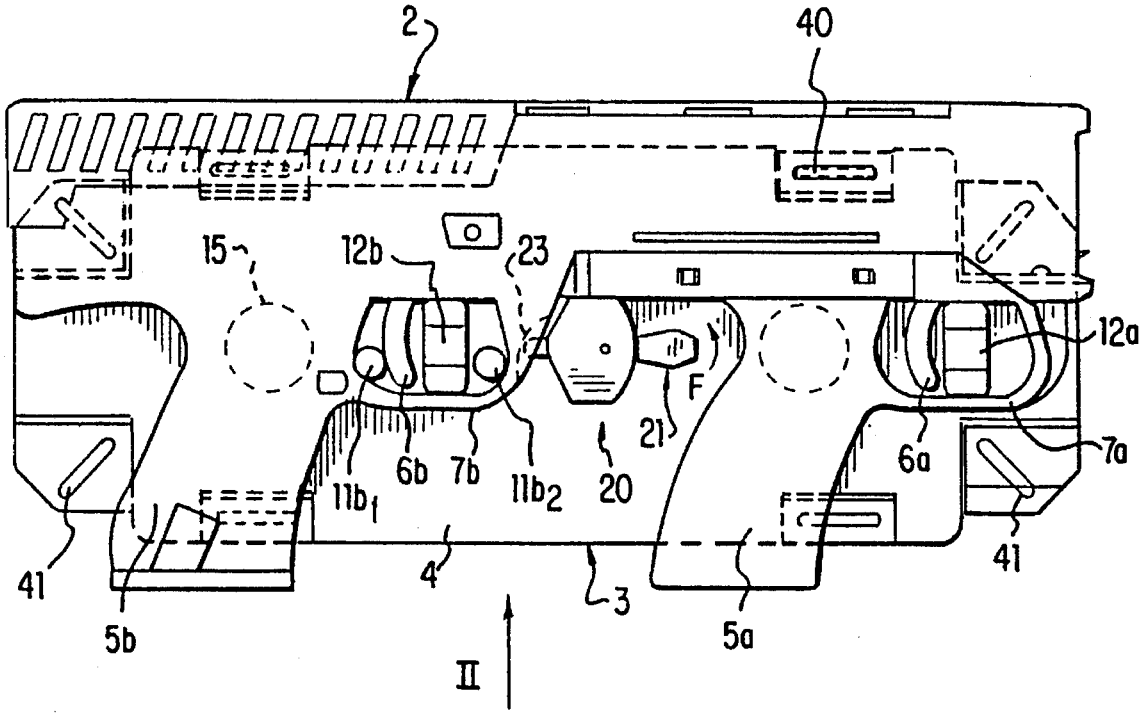
FIG. 1 is a front view of the carrying system of a portable weapon according to a first embodiment of the invention.
Figure 2:
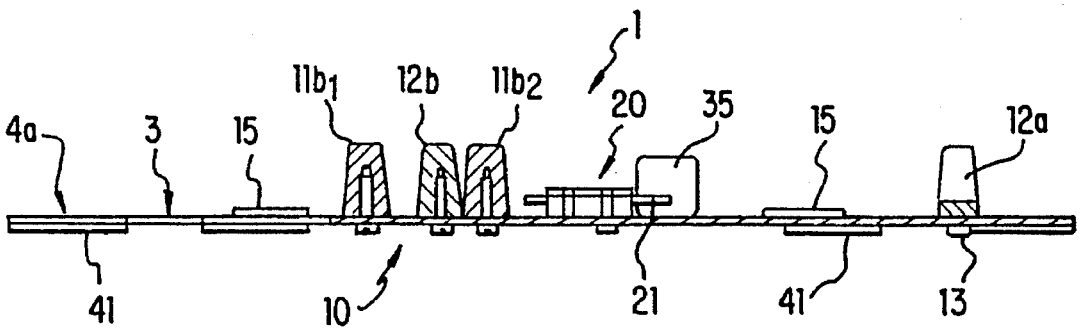
FIG. 2 is a side view looking in the direction of arrow II in FIG. 1.

A carrying system 1 for a portable weapon 2 according to a first embodiment, illustrated in FIGS. 1 to 4, is constituted by a rigid support 3 in the form of a substantially rectangular support plate 4 against which weapon 2 is pressed. The weapon, in the example illustrated in FIG. 1, is an automatic pistol having a front grip (5*a*) and a rear grip (5*b*) associated respectively with a front trigger (6*a*) and a rear trigger (6*b*). In a known manner, each trigger 6*a*,6*b* is surrounded by a respective trigger guard 7*a*,7*b*, a part with the general shape of a semicircle designed to protect the trigger and secure it against inadvertent operation.

Support plate 4 is equipped on one of its main surfaces 4*a* with means 10 (FIG. 2) which allow the weapon 2 to be correctly positioned and centered against support plate 4 and a locking device 20 which retains weapon 2 once the latter is resting against the support plate 4.

Means 10, that allow the weapon 2 to be positioned and centered against the support plate 4, are comprised of posts $11b_1$, $11b_2$, and 12*a*,12*b* projecting from the main surface 4*a* of support plate 4 and attached thereto by screws 13. More specifically, with reference to FIGS. 1 and 2, two posts $11b_1$,$11b_2$ are provided which are designed to be accommodated in the internal space delimited by rear trigger guard 7*b* and be positioned on either side of trigger 6*b*. Both posts $11b_1$,$11b_2$ are aligned in a direction parallel to the lengthwise direction of support plate 4 to come substantially into contact with rear trigger guard 7*b*. The dimensions of post 11*b* located further back are such that it comes into the immediate vicinity of rear trigger 6*b* in order to immobilize the latter. Two posts 12*a*,12*b* are also provided. The posts 12*a*,12*b* are designed to engage the spaces delimited by the two trigger guards 7*a*,7*b*, respectively. The two posts 12*a*, 12*b* are dimensioned such that they come into contact with the front trigger guard 7*a* and the rear trigger guard 7*b* in a direction transverse to the longitudinal axis of the support plate 4. Post 12*a* is positioned between the front trigger 6*a* and the front part of front trigger guard 7*a*, allowing front trigger 6*a* to be manipulated, and post 12*b* is positioned between the rear trigger 6*b* and post $11b_2$.

To perfect the positioning and centering of the weapon 2 against the support plate 4, inserts 15 mounted on main surface 4*a* of support plate 4 may also be provided. Inserts 15, when present, cooperate with parts of the weapon 2 that have a shape that is complementary to that of the inserts 15.

Figure 3:
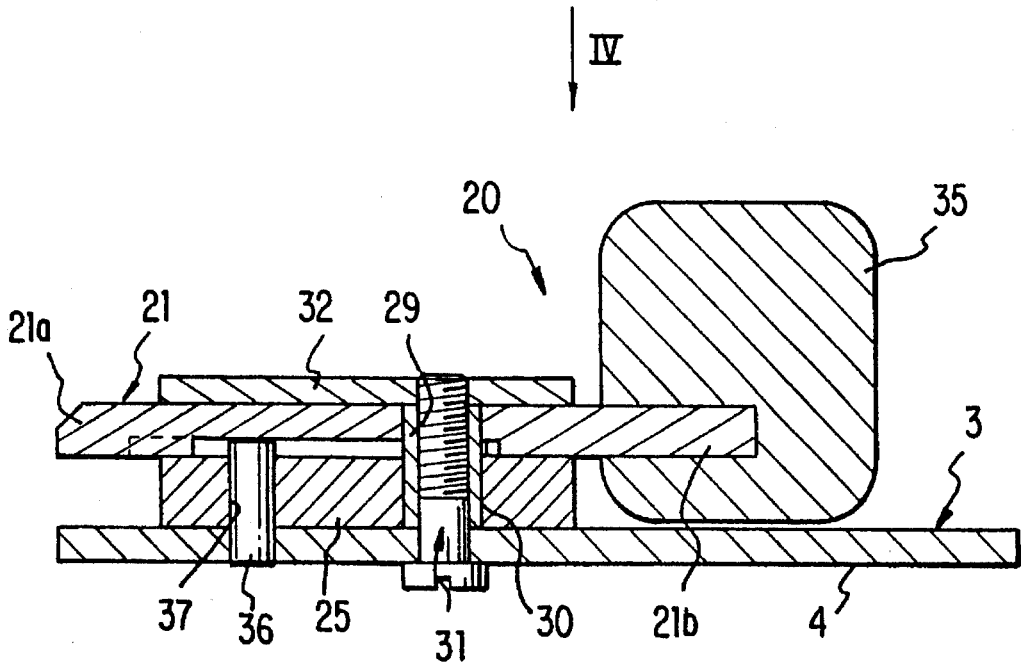
FIG. 3 is a cross-sectional view of the locking device of the weapon.
Figure 4:
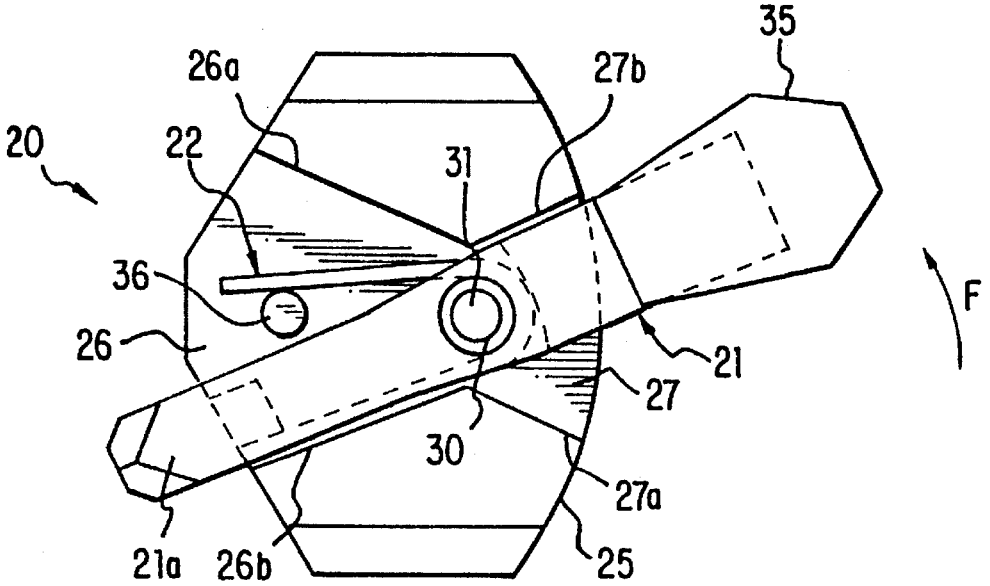
FIG. 4 is a top view looking in the direction of arrow IV in FIG. 3.

With reference to FIGS. 1, 3, and 4, the device 20, for locking the weapon 2 against the support plate 4, has a manually controlled movable finger 21, that can assume two positions, and an elastic return element 22 that returns the finger 21 to one of the positions, or a locking position, where its end 21*a* engages a groove 23 of the weapon 2 to lock the latter against the support plate 4.

With reference to FIG. 3, locking device 20 has a support block 25 of which one main surface has a first recess 26, generally frustroconical in shape which is delimited by two oblique edges 26*a* and 26*b*, and a second recess 27, also frustroconical in shape which is delimited by two oblique edges 27*a* and 27*b*. The two frustra formed by the two recesses 26,27 have their tops facing one another, and the two nonconsecutive edges 26*a*,27*a* of the respective two recesses 26,27 are parallel, as are their two other nonconsecutive edges 26*b*,27*b*.

Support block 25 is traversed by a bore 29 located in the vicinity of the junction between the two recesses 26 and 27. A sleeve 30 is engaged in bore 29 and is traversed by a screw 31 used to attach the support block 25 to the support plate 4 and to attach a cover 32, mounted on the main surface of the support block 25 which has the recesses 26,27.

Finger 21 is seated in the space formed by the two recesses 26,27, is pivotably mounted on the sleeve 30, and is movable in a plane parallel to that of the support plate 4. Finger 21 projects at end 21*a* beyond recess 26, while its other end 21*b* projects beyond recess 27. A knob 35, mounted on end 21*b* of the finger 21, is used to cause the finger 21 to pivot in recesses 26,27 between the two positions defined respectively by the edges 26*a*,27*a* of the recesses 26,27, which form a first stop, and the edges 26*b*,27*b* of the two recesses 26,27 which form a second stop.

Support block 25 is immobilized rotationally by means of a pin 36 located on the median axis, one end of the pin 36 engages the support plate 4 and the other end engages a second bore 37 in the support block 25. Advantageously, the pin 36 projects into the recess 26 to cooperate with the flat spring 22 which is mounted in the plane of the recess 26 such as to return the finger 21 automatically, by its return force, into a locking position.

Thus, by exerting a force in the direction indicated by arrow F (FIG. 4) against the force exerted by the spring 22, the finger 21 is made to pivot about the sleeve 30 to abut the edges 26*b*,27*b* of the respective two recesses 26,27 which determine the second position or opening position of the locking device 20.

In the first embodiment illustrated in FIG. 1, the locking device 20 is positioned on the support plate 4 so that it is located between the rear trigger guard 7*b* and the front grip 5*a*. The outer wall of the rear trigger guard 7*b* faces the front grip 5*a* and contains a groove 23 designed to cooperate with the free end 21 of locking finger 21.

Finally, the support plate 4 is worn by the shooter with at least one retaining strap 40 in order to immobilize it, for example, at the shooter's belt. For this purpose, the support plate contains several slots 41 positioned around its periphery for free passage of the retaining strap or straps 40.

Assume that weapon 2 is positioned and centered against the main surface 4*a* of support plate 4, and that the free end 21*a* of locking finger 21 is engaged in groove 23 of the rear trigger guard 7*b* and held therein by the action exerted by the return spring 22 on the locking finger 21. Weapon 2 is then immobilized and attached to the support plate 4 by the locking device 20 (FIG. 1), and the support plate 4 is immobilized at the shooter's belt by means of the retaining straps 40.

When the shooter decides to draw the weapon 2, the weapon 2 is grasped by its front grip 5*a* with one hand, whereupon the thumb of the grasping hand naturally comes in contact with the knob 35 of the locking device 20. The position of the hand around the grip 5*a* forces the locking finger 21 to pivot in the direction of arrow F, which has the effect of releasing the locking finger 21 from the groove 23 of the rear trigger guard 7*b* of the weapon 2. At the same time, the shooter begins a movement in a direction perpendicular to the plane of the support plate 4 to release the weapon 2 and can then very rapidly aim weapon 2 in a given direction, continuing the movement begun with releasing the weapon 2 from the support plate 4.

When the shooter decides to attach the weapon 2 to the support plate 4, the shooter returns the weapon 2 to the support plate 4 by positioning and centering the weapon 2 correctly relative to posts 11*b*,11*b*$_2$,12*a*,12*b*. During the movement of the weapon, the shooter uses the thumb of the hand located around the front grip 5*a* to hold locking finger 21 in its open position, so that when the weapon 2 is pressed against the support plate 4 and the shooter removes the hand from the front grip 5*a*, the locking finger 21 engages automatically in groove 23 due to the action of the return spring 22.

Since the support plate 4 and the positioning and immobilization means of the weapon are symmetrical relative to the median lengthwise axis of the support plate 4, the weapon 2 can be placed on either side of this axis, allowing the same carrying system to be used by a left-handed or a right-handed person.

Figure 5:
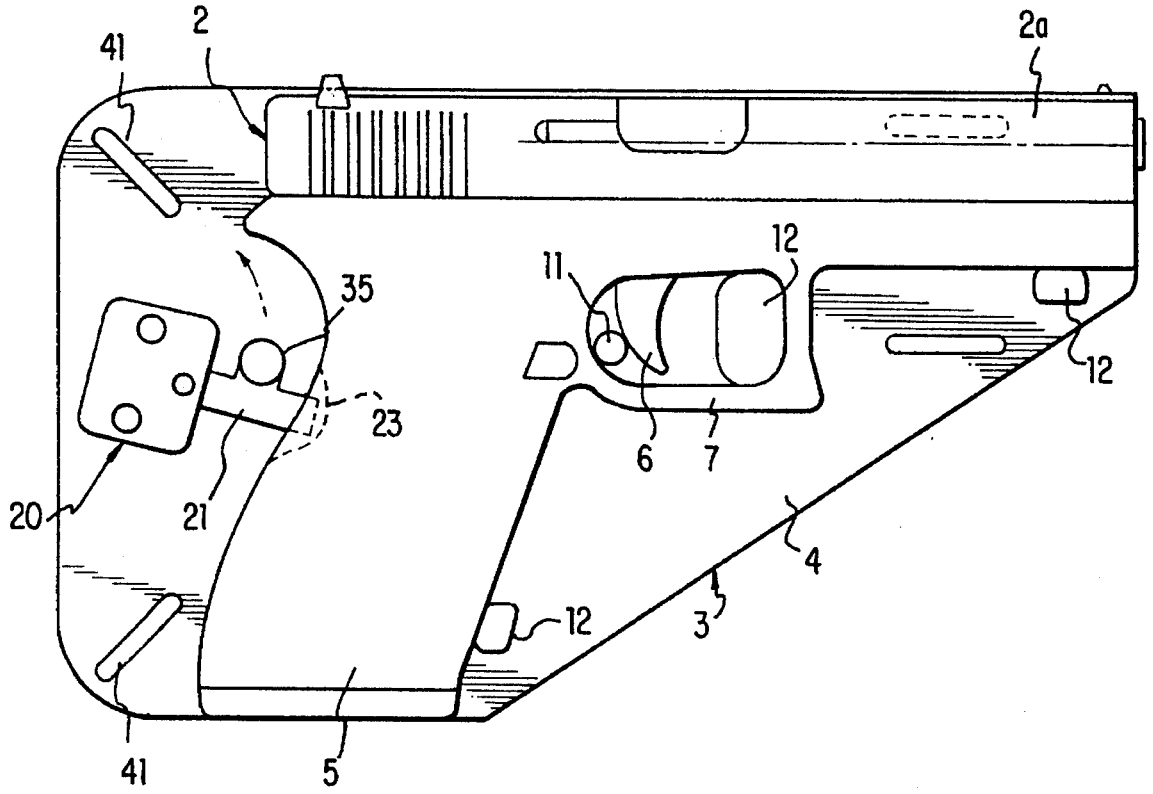
FIG. 5 is a front view of the carrying system for a portable weapon according to a second embodiment of the invention.

According to a second embodiment of the invention, as illustrated in FIG. 5, weapon 2 is, for example, an automatic pistol with a grip 5 and a trigger 6 that is surrounded by a trigger guard 7.

For this type of weapon 2, the locking device 20 is positioned behind the grip 5 so that the free end of its locking finger 21 can engage a groove 23 formed on the rear face of the grip 5 which is opposite the locking device 20.

As in the previous embodiment, means are provided for positioning and centering weapon 2 against support plate 4. These means also comprise posts which project from the main face 4*a* of the support plate 4. Specifically, a post 11 projects inside the space delimited by trigger guard 7. The dimensions of the post 11 are such that the post 11 comes substantially into contact with trigger 6 to immobilize the latter. Also, three posts 12 are provided, one post 12 which engages the internal space of trigger guard 7, one post which comes in contact with the front face of grip 5, and one post 12 which abuts the lower face of barrel 2*a* of weapon 2.

As in the previous embodiment, when the shooter grasps grip 5 with one hand, the thumb of the hand naturally comes in contact with the knob 35 of the locking finger 21, causing the locking finger 21 to pivot and releasing the locking finger 21 from the groove 23. When the shooter replaces the weapon 2 on support plate 4, and releases grip 5, the locking finger 21 automatically repositions itself in the groove 23 under the action of the return spring (not shown in FIG. 5).

Of course, the invention is not confined to the two embodiments described above and provided only as an example. In particular, it is possible to modify the nature and number of the posts serving to position and center the weapon 2 against the support plate 4, particularly as a function of the type of portable weapon used.

What is claimed is:

1. A carry system for a portable weapon having a groove in an outer surface thereof comprising:

a support;

a locking device to secure the weapon on the support; and at least one retaining strap for attaching the support to a user, wherein said support further comprises a rigid support plate and said locking device is supported on said support plate, said locking device comprising a manually controlled pivotally mounted finger that can assume either of two positions said finger mounted such that an arc subscribed by said free end of said finger lies in a plane parallel to a plane of said support plate, and an elastic element for returning said finger to one of said two positions which is a locking position where a free end of said finger is adapted to engage said groove of the weapon to lock the weapon against said support plate.

2. The carrying system for a portable weapon according to claim 1, the weapon having a front and a rear grip, a front and a rear trigger, and a front and a rear trigger guard respectively surrounding said front and rear triggers, wherein said groove is formed on the outer surface of the rear trigger guard of the weapon.

3. The carrying system for a portable weapon according to claim 2, wherein said locking device is mounted on said support plate and is positioned between the rear trigger guard and the front grip of the weapon.

4. The carrying system for a portable weapon according to claim 1, the weapon having a grip, a trigger, and a trigger guard surrounding the trigger, wherein said groove is provided on a rear face of the grip of the weapon.

5. The carrying system for a portable weapon according to claim 4, wherein the locking device is mounted on the support plate to be positioned to a rear side of the grip of the weapon.

6. A carrying system for a portable having a groove in an outer surface thereof weapon, comprising:

a support;

a locking device to secure the weapon on the support; and at least one retaining strap for attaching the support to a user, wherein said Support further comprises a rigid support plate and said locking device is supported on said support plate, said locking device comprising a manually controlled movable finger that can assume either of two positions, and an elastic element for returning said finger to one of said two positions which is a locking position where said finger is adapted to engage said groove of the weapon to lock the weapon against said support plate, the carrying system further comprising positioning means for positioning and centering the weapon against the support plate, said positioning means is comprised of a plurality of posts projecting from a main surface of said support plate.

7. The carrying system for a portable weapon according to claim 6, wherein at least one post engages a space delimited by a trigger guard of the weapon to immobilize a trigger of the weapon.

* * * * *